US008389848B1

(12) United States Patent
Baker

(10) Patent No.: US 8,389,848 B1
(45) Date of Patent: Mar. 5, 2013

(54) ELECTRO-MECHANICALLY ASSISTED BASS DRUM PEDAL AND METHOD OF USE

(75) Inventor: William Thomas Baker, Ann Arbor, MI (US)

(73) Assignee: BakBeat, LLC, Ann Arbor, MI (US)

( * ) Notice: Subject to any disclaimer, the term of this patent is extended or adjusted under 35 U.S.C. 154(b) by 0 days.

(21) Appl. No.: 13/400,152

(22) Filed: Feb. 20, 2012

(51) Int. Cl.
*G10H 3/00* (2006.01)
*G10H 1/40* (2006.01)

(52) U.S. Cl. ..... 84/746; 84/612; 84/635

(58) Field of Classification Search ..... 84/746
See application file for complete search history.

(56) References Cited

U.S. PATENT DOCUMENTS 6,075,191 A * 6/2000 Scire ..... 84/422.1
6,201,173 B1 * 3/2001 Black ..... 84/422.1
7,381,885 B2 6/2008 Arimoto
7,394,014 B2 7/2008 Rosenberg
8,203,065 B2 * 6/2012 Yoshino ..... 84/422.1
2006/0266199 A1 11/2006 Hilburn
2009/0007763 A1 1/2009 Steele
2010/0319519 A1 12/2010 Takehisa et al.

* cited by examiner

*Primary Examiner* — Christopher Uhlir
(74) *Attorney, Agent, or Firm* — Jelic Patent Services, LLC; Stanley E. Jelic

(57) ABSTRACT

An apparatus and method to assist a drummer playing a bass drum. The apparatus enables a drummer to combine force applied to a foot plate, frequency applied to a foot plate, and a selected algorithm to output a mechanical force to a bass drum beater. The apparatus provides drummers the ability to produce a variety of desired rhythmic patterns, to change the intensity of the stroke, to vary the tempi so that patterns will be consistent with the music being performed, and to produce a metronomic beat (tempo) when desired. Hence, drummer fatigue is reduced, the drummer can produce more complicated and varying patterns on the fly, and the drummer has the ability to change the stroke to accent beats.

10 Claims, 8 Drawing Sheets

ELECTRO-MECHANICALLY ASSISTED BASS DRUM PEDAL AND METHOD OF USE

FIELD OF THE INVENTION

The present disclosure is in the technical field of enhancements for musical instruments. More particularly, the present disclosure focuses on electro-mechanically assisting a pedal for a bass drum.

BACKGROUND OF THE INVENTION

A conventional bass drum (kick) pedal consists of a footplate and beater. The drummer steps on the footplate to drive the beater against the drum head. The footplate and beater are connected by a spring mechanism that serves to withdraw the beater from the head once it is struck.

BRIEF SUMMARY OF THE INVENTION

The present disclosure describes an apparatus and method to supplement a drummer's natural ability to perform using a drum set. The apparatus is an electro-mechanically assisted bass drum pedal, which comprises: a foot plate to accept a force from a drummer's foot; a first sensor to measure the frequency that the force is exerted on the foot plate; a second sensor to measure the amount of force that is exerted on the foot plate; a user interface which enables the drummer to select from a plurality of algorithms; a computing environment which accepts inputs from the first sensor, second sensor, and user interface to calculate an output; an actuator which accepts the computing environment output to generate a mechanical force; and a beater which accepts the mechanical force and translates it to a force which is exerted upon a bass drum. Element connections within the apparatus can be hardwired or wireless.

The foot plate typically rests at an incline relative to the floor, the incline being maintained by an integral spring. The incline can be anywhere between 0-90 degrees (typically 0-60 degrees), dependent upon the spring setting. As the drummer exerts a force upon the foot plate, the foot plate is depressed and the angle relative to the floor is reduced. The drummer can separately exert a force near the top of the foot plate (the drummer's toes) and the bottom of the foot plate (the drummer's heel). In another embodiment, the force sensor(s) are both located below the top of the foot plate and a lighter touch impacts only the top force sensor, while a heavier touch impacts both. In another embodiment, no integral spring is used and the force sensors are attached either separately at the toe and heel, or one above the other at the toe as in the previous embodiment. Additionally, the foot pedal can be connected to a bass drum, remote from the bass drum (but using a conventional foot plate), or remote from the bass drum and affixed to the drummer's shoe.

The first sensor which measures the frequency that a force is exerted upon the foot plate is typically located near the top of the foot plate. In one embodiment, the first sensor simply serves as an on-off switch, indicating either the presence or absence of the foot.

The second sensor which measures the amount of force that is exerted on the foot plate is typically located near the bottom of the foot plate. In one embodiment, the force sensor enables the drummer to continue strokes being applied to the drum head for as long as pressure is being applied by the drummer's foot. In another embodiment, the force sensor enables the drummer to vary stroke intensity from regular to accented. In another embodiment, the force sensor does not need to be connected to the foot pedal, which enables the drummer to keep his foot in a more comfortable position. In another embodiment, the force sensor does not need to be connected to the foot pedal and can be positioned a selectable distance from the drummer, thereby giving the drummer greater flexibility in the arrangement of other drums, cymbals, and hardware. In another embodiment, the second sensor simply serves as an on-off switch, via the presence or absence of the foot, and indicates to the computing environment that a parameter should be changed such as pulse, force, musical pattern, or the like.

The user interface can include a combination of input devices such as knobs, buttons, and the like. Typically, a graphical display is also incorporated to provide the drummer visual confirmation of the selected algorithm. Examples of algorithms include basic tempi mm 60-160, triplet and quarter subdivisions throughout range of tempi, compressed pulses within a subdivision, recurring pulse patterns, unique pulse patterns, alternate time signatures, stresses within pulse patterns, signals which activate remote devices, and the like. In some embodiments, the user interface can be simple or multifunctional, accept memory cards, or accept additional electronic inputs (e.g. via USB port or the like).

The computing environment which accepts inputs from the first sensor, second sensor, and user interface to calculate an output will have a plurality of algorithms stored in memory. The computing environment will be able to continuously apply current frequency and force signals from the foot pedal sensors to the algorithm. This will enable the drummer to lock onto a tempo, more accurately produce a rhythmic pattern pattern that distinguishes sixteenth note from triplet patterns, enable the drummer to increase the speed (e.g. double the speed) of executing a rhythmic pattern, and the like.

The actuator can be any electro-mechanical device which accepts an electronic signal and outputs a mechanical force.

The beater is a standard drum beater which is configured to receive a force from the actuator and then translate that force to impact the bass drum accordingly. In another embodiment, a custom drum beater is configured to receive a force from the actuator and then translate that force to impact the bass drum accordingly. In another embodiment, multiple drum beaters are configured to receive forces from the actuator and then translate those force to impact the bass drum accordingly and more rapidly than possible using a single beater. In other embodiments, the beater uses a direct drive, the beater uses a pivot to accept extant beaters, the beater is configured to double stroke speed, two beaters are used with separate pistons instead of one beater/piston, or the like.

The method to supplement a drummer's natural ability to perform using a drum set comprises: applying a force to a foot plate with a drummer's foot; measuring the frequency that the force is exerted on the foot plate with a first sensor; measuring the amount of force that is exerted on the foot plate with a second sensor; selecting from a plurality of algorithms with a user interface; accepting inputs from the first sensor, second sensor, and user interface with a computing environment to calculate an output; accepting the computing environment output with an actuator to generate a mechanical force; and accepting the mechanical force with a beater and translating it to a force which is exerted upon a bass drum.

The scope of the invention is defined by the claims, which are incorporated into this section by reference. A more complete understanding of embodiments on the present disclosure will be afforded to those skilled in the art, as well as the realization of additional advantages thereof, by consideration of the following detailed description of one or more embodiments. Reference will be made to the appended sheets of drawings that will first be described briefly.

The following detailed description of the invention is merely exemplary in nature and is not intended to limit the invention or the application and uses of the invention. Furthermore, there is no intention to be bound by any theory presented in the preceding background of the invention or the following detailed description of the invention.

DETAILED DESCRIPTION OF THE INVENTION

Not every drummer having to perform using a drum set has the reflexes or endurance to produce desired rhythmic patterns on the bass drum (kick). Hence, a need exists to supplement a drummer's natural ability to perform using a drum set.

The present disclosure describes an apparatus and method which fulfills the need described above. The apparatus is an electro-mechanically assisted bass drum pedal. The apparatus provides drummers the ability to produce a variety of desired rhythmic patterns, to change the intensity of the stroke, to vary the tempi so that patterns will be consistent with the music being performed, and to produce a metronomic beat (tempo) when desired. Hence, drummer fatigue is reduced, the drummer can produce more complicated and varying patterns on the fly, and the drummer has the ability to change the stroke to accent beats.

Figure 1:
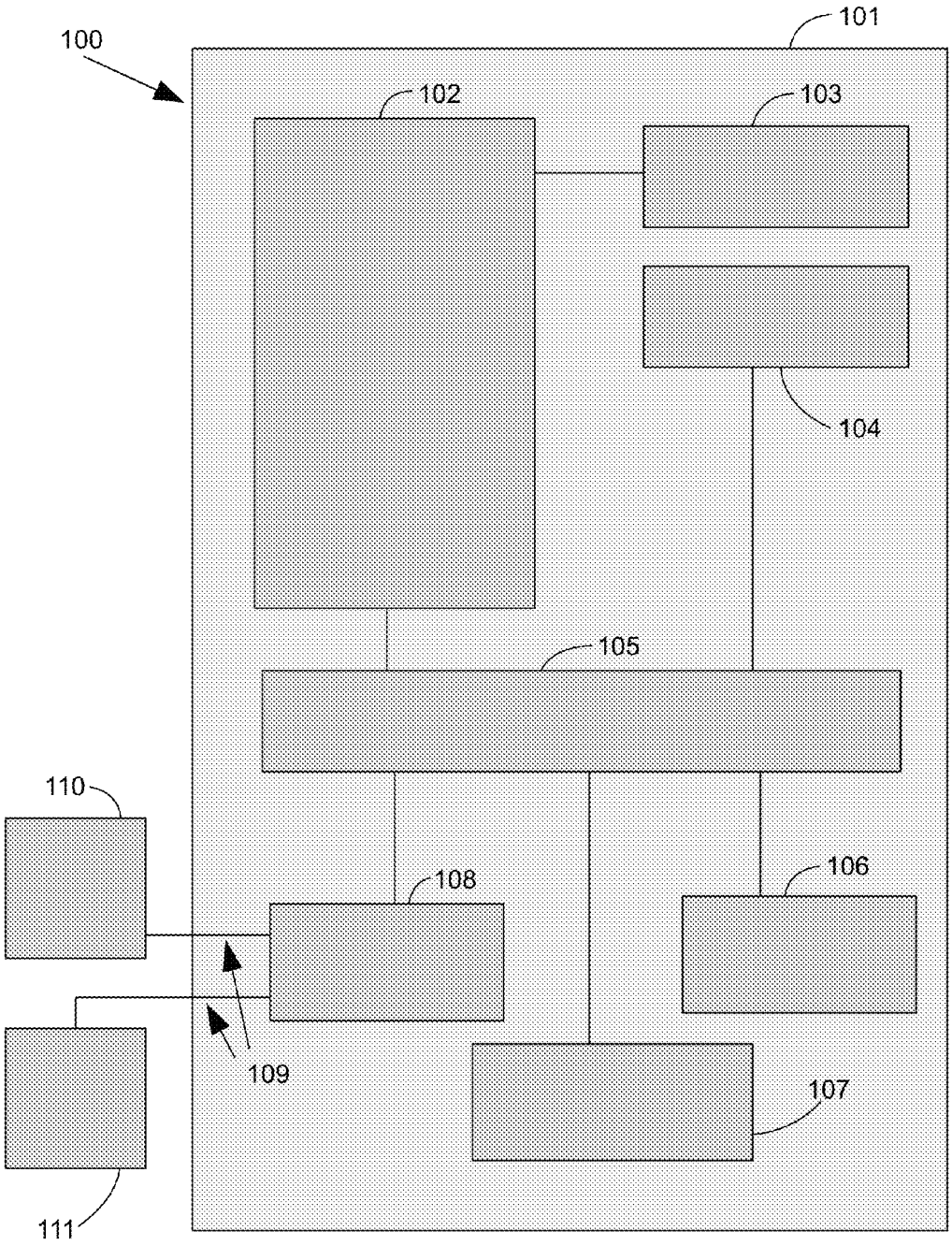
FIG. 1 is a block diagram of a typical computing environment used for implementing embodiments of the present disclosure.

FIG. 1 is a block diagram of a typical computing environment used for implementing embodiments of the present disclosure. FIG. 1 shows a computing environment 100, which can include but is not limited to, a housing 101, processing unit 102, volatile memory 103, non-volatile memory 104, a bus 105, removable storage 106, non-removable storage 107, a network interface 108, ports 109, a user input device 110, and a user output device 111.

Figure 2:
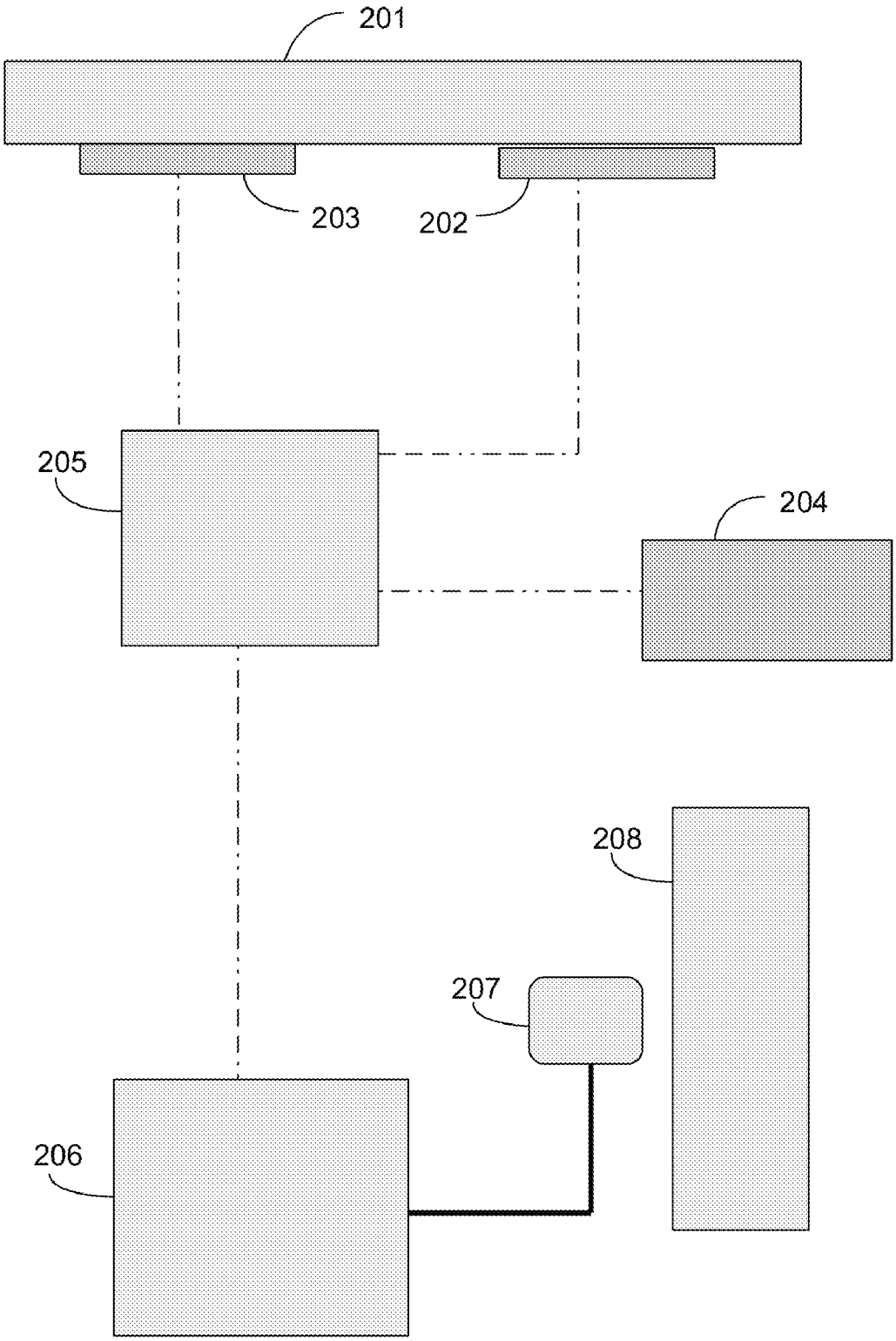
FIG. 2 shows a schematic of an electro-mechanically assisted bass drum pedal.

FIG. 2 shows a schematic of an electro-mechanically assisted bass drum pedal. A drummer applies a force and frequency to a foot pedal 201. A first sensor 202 measures the frequency while a second sensor 203 measures the force. The drummer also selects an algorithm via a user interface 204. A computing environment 205 has a plurality of stored algorithms. The computing environment 205 combines the force, frequency, and algorithm inputs to output an electrical signal to an actuator 206. The actuator 206 accepts the electrical signal and outputs a mechanical force to a beater 207. The beater 207 translates the mechanical force to a corresponding force which is applied to a bass drum 208.

Figure 3:
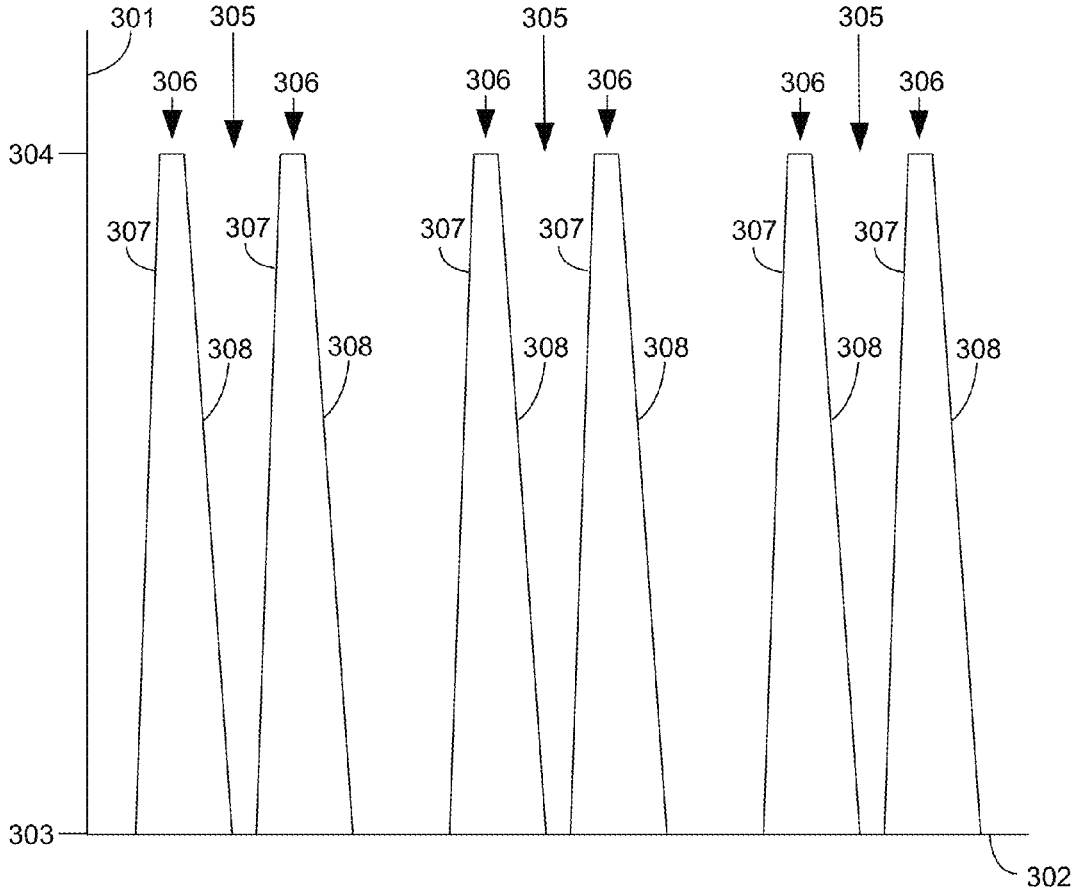
FIG. 3 shows the relationship between force, frequency, and a selected algorithm.

FIG. 3 shows the relationship between force, frequency, and a selected algorithm. FIG. 3 shows beater position % 301 (y-axis) as a function of time 302 (x-axis). Beater position % 301 can vary from 0% 303 to 100% 304. The algorithm shows three beats 305 with two pulses 306 per beat 305. The upward slope 307 is a function of force and the downward slope 308 is a function of the beater return spring. Both the time between pulses 306 and the time between beats 305 are functions of frequency. Note that a greater force will create a greater volume of sound.

Figure 4:
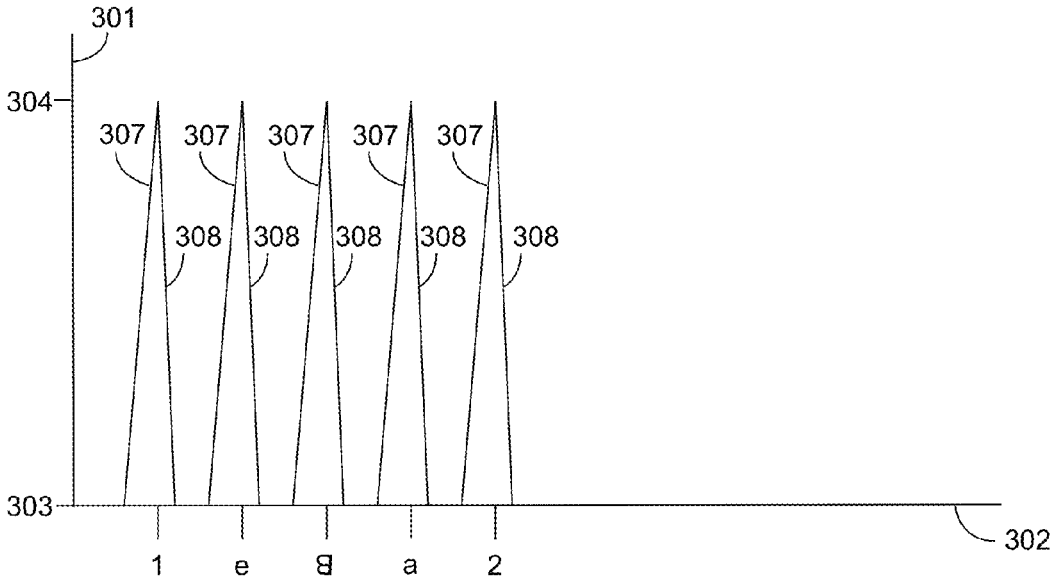
FIG. 4 shows a strict time algorithm.

FIG. 4 shows a strict time algorithm. Four pulses are shown within one beat using the same amount of force and the pulses are equidistant (continuous frequency). FIG. 4 shows beater position % 301 (y-axis) as a function of time 302 (x-axis). Beater position % 301 can vary from 0% 303 to 100% 304. The upward slope 307 is a function of force and the downward slope 308 is a function of the beater return spring.

Figure 5:
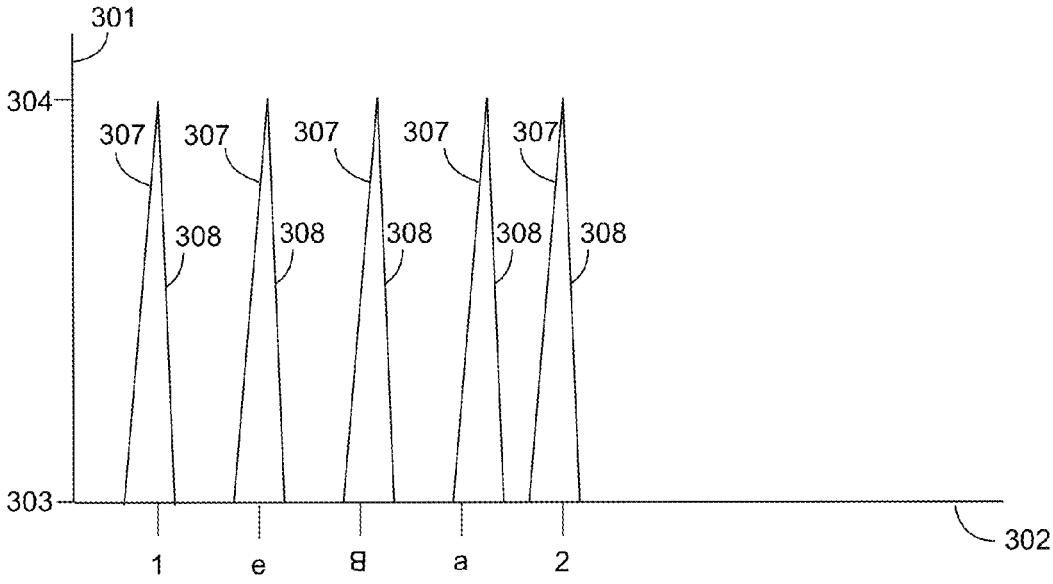
FIG. 5 shows a driving algorithm.

FIG. 5 shows a driving algorithm. Four pulses are shown within one beat using the same amount of force and the pulses are not equidistant (varied frequency). FIG. 5 shows beater position % 301 (y-axis) as a function of time 302 (x-axis). Beater position % 301 can vary from 0% 303 to 100% 304. The upward slope 307 is a function of force and the downward slope 308 is a function of the beater return spring.

Figure 6:
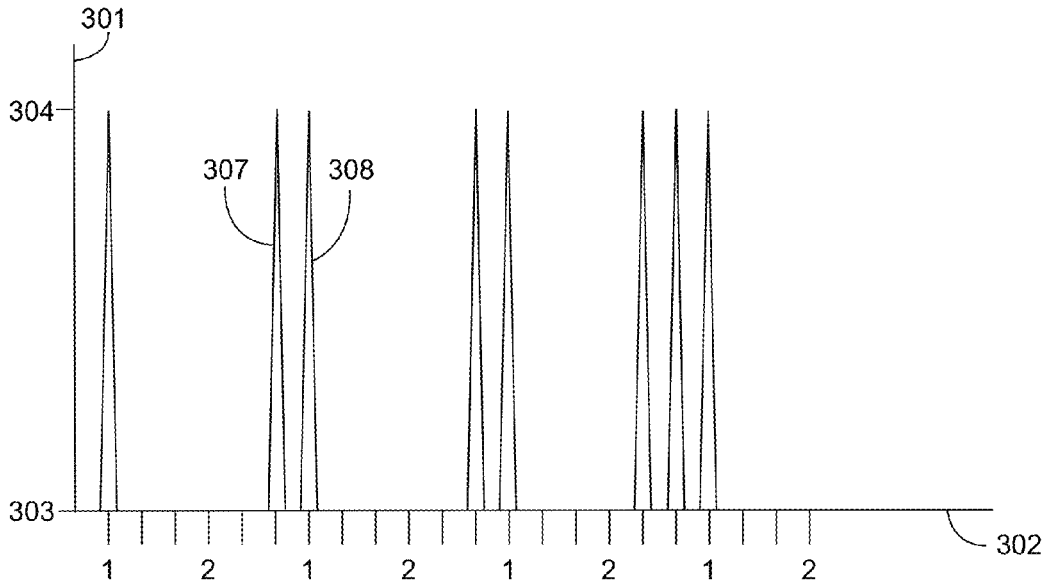
FIG. 6 shows a blues algorithm with 3 pulses per beat.

FIG. 6 shows a blues algorithm with 3 pulses per beat. FIG. 6 shows beater position % 301 (y-axis) as a function of time 302 (x-axis). Beater position % 301 can vary from 0% 303 to 100% 304. The upward slope 307 is a function of force and the downward slope 308 is a function of the beater return spring.

Figure 7:
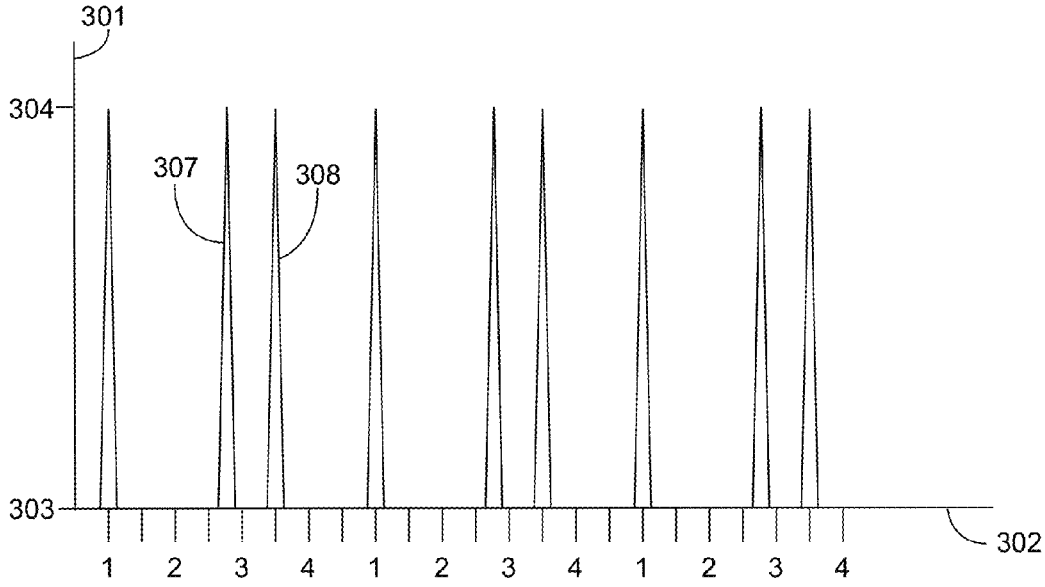
FIG. 7 shows a rock algorithm with 4 pulses per beat.

FIG. 7 shows a rock algorithm with 4 pulses per beat. FIG. 7 shows beater position % 301 (y-axis) as a function of time 302 (x-axis). Beater position % 301 can vary from 0% 303 to 100% 304. The upward slope 307 is a function of force and the downward slope 308 is a function of the beater return spring.

Figure 8:
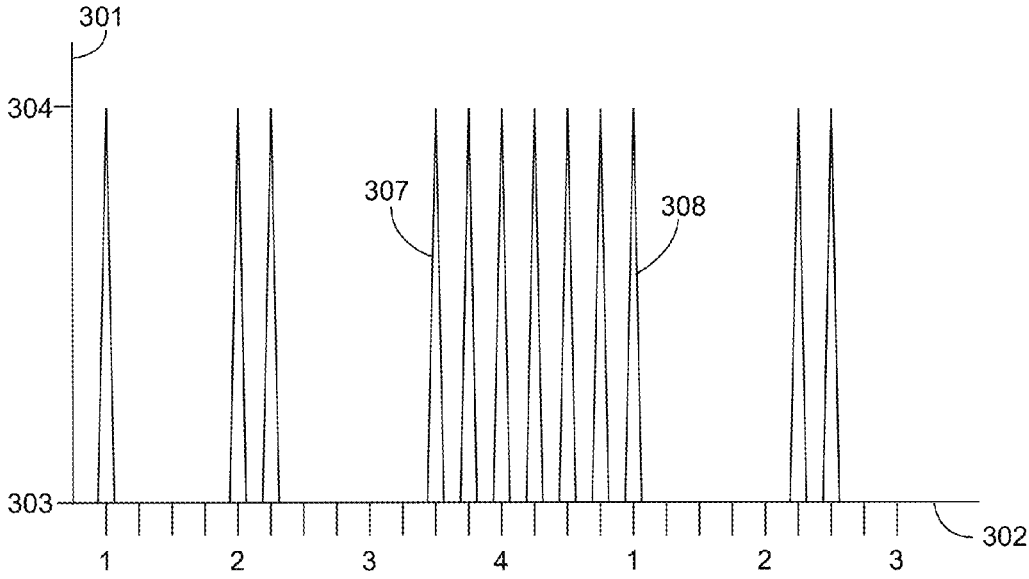
FIG. 8 shows a hi-hop algorithm with 4 pulses per beat.

FIG. 8 shows a hi-hop algorithm with 4 pulses per beat. FIG. 8 shows beater position % 301 (y-axis) as a function of time 302 (x-axis). Beater position % 301 can vary from 0% 303 to 100% 304. The upward slope 307 is a function of force and the downward slope 308 is a function of the beater return spring.

Figure 9:
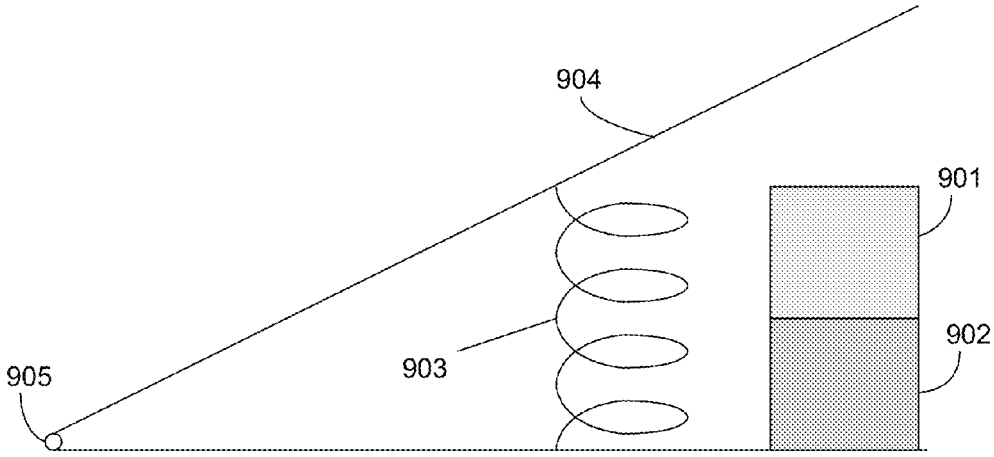
FIG. 9 shows a foot pedal embodiment with two sensors at the toe.

FIG. 9 shows a foot pedal embodiment with two sensors at the toe. The top sensor 901 measures frequency and is more sensitive than the bottom sensor 902 which measures force. A spring 903 returns the foot pedal 904 to uncompressed position about a pivot 905.

Figure 10:
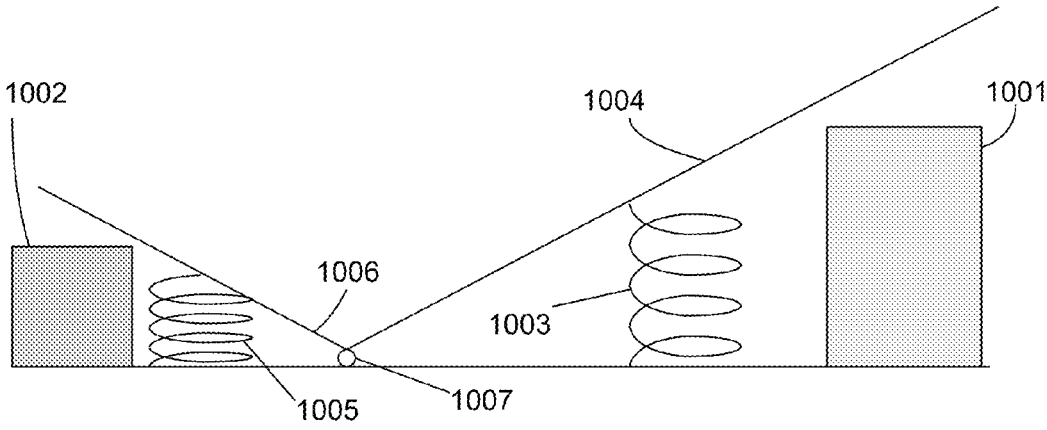
FIG. 10 shows a foot pedal embodiment with one sensor at the toe and one sensor at the heel.

FIG. 10 shows a foot pedal embodiment with one sensor at the toe and one sensor at the heel. The toe sensor 1001 measures frequency and the heel sensor 1002 measures force. Toe spring 1003 returns the foot pedal toe portion 1004 to uncompressed position while heel spring 1005 returns the foot pedal heel portion 1006 to uncompressed position. Both the foot pedal toe portion 1004 and the foot pedal heel portion 1006 rotate about a pivot 1007.

Figure 11:
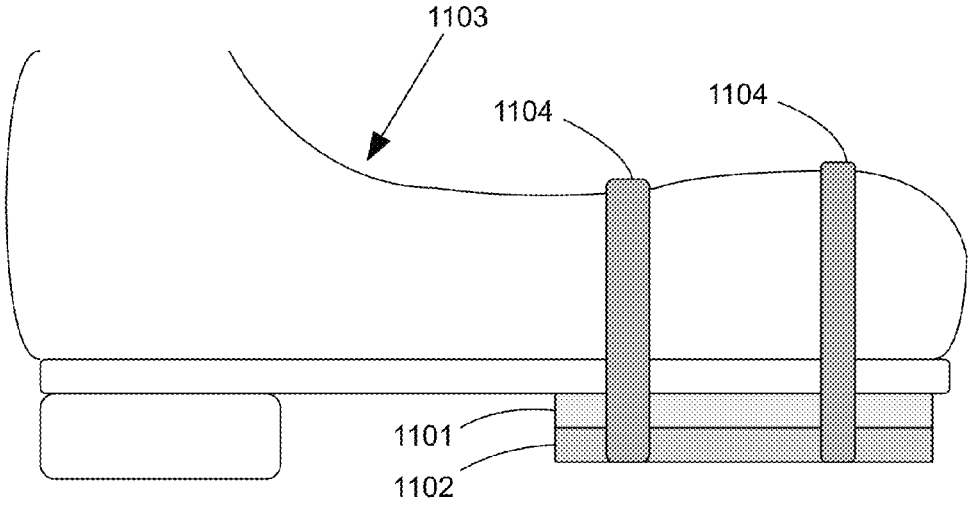
FIG. 11 shows a spring-less foot pedal embodiment.

FIG. 11 shows a spring-less foot pedal embodiment. The top sensor 1101 measures frequency and is more sensitive than the bottom sensor 1102 which measures force. A shoe 1103 is tied to the sensors with strap-like fasteners 1104.

Figure 12:
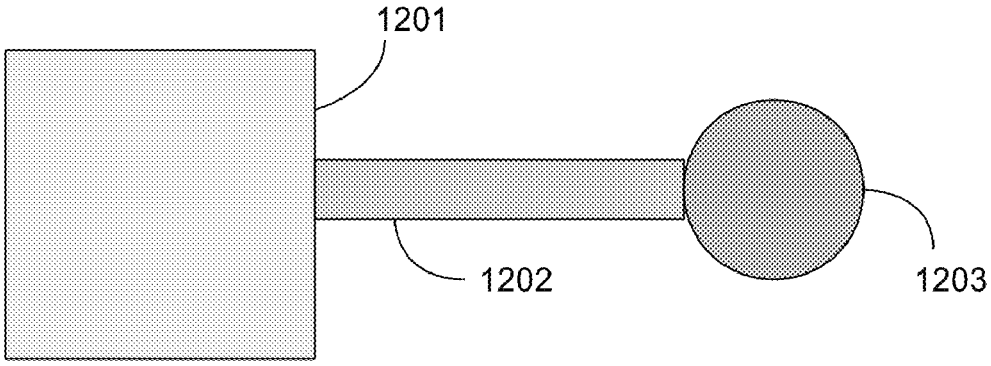
FIG. 12 shows an actuator embodiment with a piston.

FIG. 12 shows an actuator embodiment with a piston. An actuator 1201 uses a piston 1202 to directly drive a beater 1203.

Figure 13:
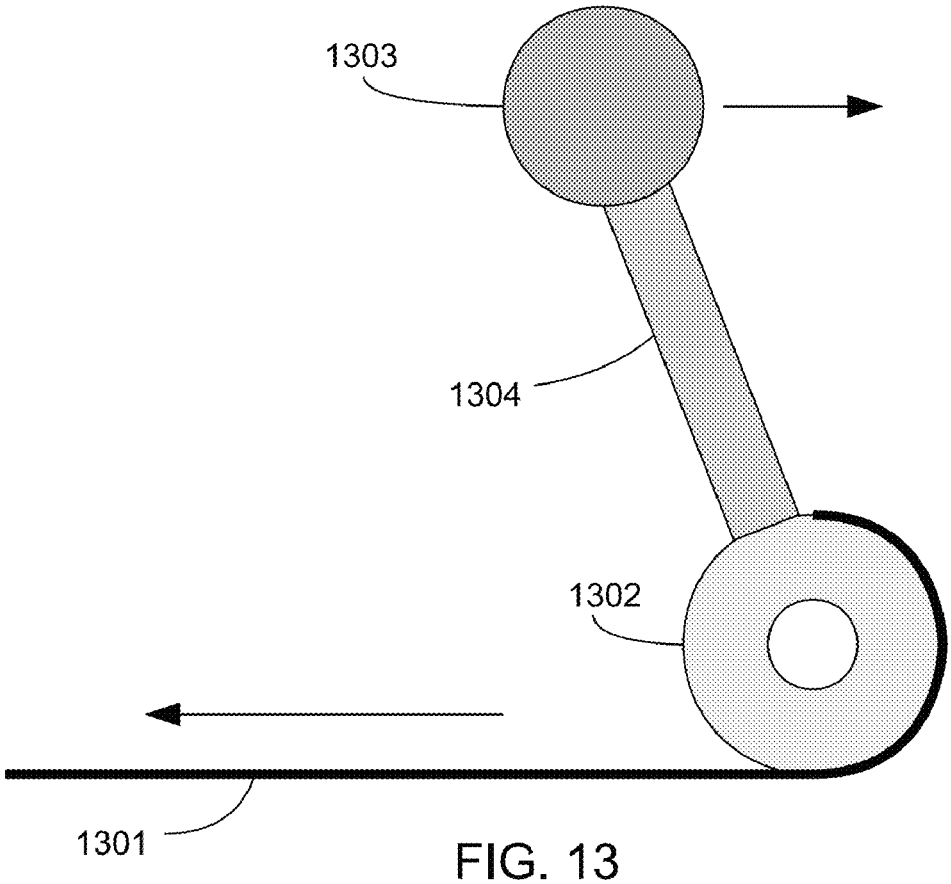
FIG. 13 shows an actuator embodiment with a belt or chain.

FIG. 13 shows a beater embodiment with a belt or chain. A actuator (not shown) exerts a pulling force upon a belt or chain 1301. Force is transferred about a pivot 1302 to a beater

1303 via a shaft 1304. The direction of the pulling force and resulting direction of the beater are shown with directional arrows.

While the present invention has been described with reference to exemplary embodiments, it will be readily apparent to those skilled in the art that the invention is not limited to the disclosed or illustrated embodiments but, on the contrary, is intended to cover numerous other modifications, substitutions, variations and broad equivalent arrangements that are included within the spirit and scope of the following claims.

I claim:

1. An electro-mechanically assisted bass drum pedal apparatus, the apparatus comprising:

a foot plate to accept a force from a drummer's foot;

a first sensor to measure a frequency that the force is exerted on the foot plate;

a second sensor to measure a magnitude of the force that is exerted on the foot plate;

a user interface which enables the drummer to select from a plurality of algorithms;

a computing environment configured to accept inputs from the first sensor, second sensor, and user interface to calculate an output, wherein the computing environment further selects, based on said output, a rhythmic pattern and tempo that can be modified on the fly;

an actuator which accepts the computing environment output to generate a mechanical force, wherein a magnitude of the mechanical force is a function of the measured magnitude of the force that is exerted on the foot plate; and a beater which accepts the mechanical force and translates it to a force which is exerted upon a bass drum, wherein the beater is able to repetitively strike the bass drum with the rhythmic pattern and tempo determined by the user interface selection as long as the foot plate is held down.

2. The apparatus of claim 1, wherein the first sensor and second sensor are located near the drummer's toe.

3. The apparatus of claim 1, wherein the first sensor is located near the drummer's toe and the second sensor is located near the drummer's heel.

4. The apparatus of claim 1, further comprising a piston which transfers the mechanical force from the actuator to the beater.

5. The apparatus of claim 1, further comprising a belt or chain, pivot, and shaft which transfers force from the actuator to the beater.

6. A method to use an electro-mechanically assisted bass drum pedal apparatus, the method comprising:

applying a force to a foot plate with a drummer's foot;

measuring a frequency that the force is exerted on the foot plate with a first sensor;

measuring an amount of force that is exerted on the foot plate with a second sensor;

selecting from a plurality of algorithms with a user interface;

accepting inputs from the first sensor, second sensor, and user interface with a computing environment configured to calculate an output, wherein the computing environment further selects, based on said output, a rhythmic pattern and tempo that is adjustable on the fly;

accepting the computing environment output with an actuator to generate a mechanical force, wherein a magnitude of the mechanical force is a function of the measured amount of force that is exerted on the foot plate with a second sensor; and accepting the mechanical force with a beater and translating it to a force which is exerted upon a bass drum, wherein the beater is able to repetitively strike the bass drum with the rhythmic pattern and tempo determined by the user interface selection as long as the foot plate is held down.

7. The method of claim 6, wherein the first sensor and second sensor are located near the drummer's toe.

8. The method of claim 6, wherein the first sensor is located near the drummer's toe and the second sensor is located near the drummer's heel.

9. The method of claim 6, further comprising using a piston which transfers the mechanical force from the actuator to the beater.

10. The method of claim 6, further comprising using a belt or chain, pivot, and shaft which transfers force from the actuator to the beater.

* * * * *